US008807943B1

(12) United States Patent
Liang

(10) Patent No.: US 8,807,943 B1
(45) Date of Patent: Aug. 19, 2014

(54) TURBINE BLADE WITH TRAILING EDGE COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 483 days.

(21) Appl. No.: 12/705,787

(22) Filed: Feb. 15, 2010

(51) Int. Cl.
*F01D 5/08* (2006.01)

(52) U.S. Cl.
USPC ..... 416/97 R; 415/115

(58) Field of Classification Search
USPC ..... 416/96, 97 R, 96 R, 95, 96 A; 415/115, 415/116
See application file for complete search history.

(56) References Cited

U.S. PATENT DOCUMENTS 7,722,326 B2 * 5/2010 Beeck et al. ..... 416/97 R

* cited by examiner

*Primary Examiner* — Edward Look
*Assistant Examiner* — Maxime Adjagbe
(74) *Attorney, Agent, or Firm* — John Ryznic

(57) ABSTRACT

A turbine rotor blade with a three-pass serpentine flow cooling circuit for a mid-chord region and a triple metering and impingement cooling circuit for a trailing edge region of the blade. The triple rows of metering holes each includes regular sized metering holes in an upper span and a lower span section of the row, and a middle span metering holes having a larger flow area in order to pass more cooling air to the middle span section of the trailing edge region of the blade. The three rows of metering holes are separated by an upper continuous cooling channel and a lower continuous cooling channel.

11 Claims, 7 Drawing Sheets

View A-A

View B-B

TURBINE BLADE WITH TRAILING EDGE COOLING CIRCUIT

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically for an air cooled turbine rotor blade with trailing edge cooling circuit.

2. Description of the Related Art Including Information Disclosed Under 37 CFR 1.97 and 1.98

A gas turbine engine, such as an industrial gas turbine (IGT) engine, includes a combustor that produces a hot gas stream and a turbine that reacts with the hot gas stream to produce mechanical work. The efficiency of the engine can be increased by passing a higher temperature gas into the turbine, referred to as the turbine inlet temperature. The turbine inlet temperature is limited to the material properties of the turbine, especially the first stage rotor blades and guide vanes, as well as to the amount of cooling for these airfoils. complex airfoil cooling circuit s have been proposed to provide for ever more increases in cooling capability while minimizing the amount of cooling air used to improve performance as well as increase part life.

Turbine blades and vanes are manufactured using the investment casting process in which a ceramic core representing the internal cooling passages is placed within a mold and liquid molten metal is poured into the mold. The mold includes a space in which the molten metal will flow and harden to represent the metallic portion of the airfoil. After the molten metal has solidified, the ceramic core is leached away, leaving the internal cooling air passages formed within the solidified metal. Additional machining can be required, for example to form the rows of film cooling holes that open onto the external surface of the airfoil.

FIGS. 1-7 show a prior art turbine rotor blade for an industrial gas turbine (IGT) engine with a leading edge region cooling circuit, a mid-chord region cooling circuit, and a trailing edge region cooling circuit. FIG. 2 shows a cross section side view of this circuit in which the mid-chord region cooling circuit includes a forward flowing three-pass serpentine flow circuit with a first leg 11 positioned adjacent to the trailing edge region cooling circuit to supply cooling air for it. The T/E region cooling circuit includes three rows of metering holes (21,22,23) that are staggered in the airfoil radial direction so as to produce a series of impingement cooling against the downstream rib, followed by a row of T/E exit holes or slots 24 to discharge the spent cooling air from the airfoil. FIG. 3 shows a diagram view of this cooling air circuit. FIG. 4 shows a close-up view of the T/E region cooling circuit with the first leg 11 of the forward flowing serpentine flow cooling circuit. FIG. 5 shows a cross section back view of a section through the first row of metering holes 21 as represented by line A-A in FIG. 4. As seen in FIG. 5, the row of metering holes extends from a lower continuous cooling channel 14 to an upper continuous cooling channel 13. The row of metering and impingement holes 21-23 (each hole is both a metering hole and an impingement hole) are of the same diameter as seen in FIG. 5.

The leading edge flow circuit provides cooling primarily for the leading edge which is the critical part of the blade from a durability spent point. Cooling air is fed into the airfoil through a single pass radial channel. Skewed trip strips are used on the pressure and suction inner walls of the radial cooling channel to augment the internal heat transfer performance. A multiplicity of impingement jets from the cooling supply channel pass through a row of cross-over metering holes in a first partition rib to provide backside impingement cooling for the blade leading edge inner surface. These cross-over holes are designed to support the leading edge ceramic core during casting of the blade, including removal of ceramic core material during a leaching process. The spent impingement cooling air is then discharged through a series of small diameter showerhead film cooling holes at a relative radial angle with the leading edge surface. A portion of the impingement air is also discharged through rows of pressure side and suction side gill holes. Therefore, a combination of impingement, convection and film cooling produces a blade leading edge metal temperature within acceptable levels. The castability of this arrangement has been demonstrated. In addition, multiple compartments can also be used in the leading edge impingement channel to regulate the pressure ration across the leading edge showerhead, eliminating showerhead film blow-off problems, and achieving optimum cooling performance with adequate backflow pressure margin and minimum cooling flow.

One major problem with air cooled turbine airfoils such as that in FIGS. 1-7 is that the ceramic core, which is made of a very brittle ceramic material, can shift during the casting process or even break. When the relatively heavy molten metal is poured into the mold and flows around the ceramic core, the heavy molten metal can shift the core into a position that will produce a defective casting. Or, some of the very fine ceramic pieces within the core can even break in half, resulting in what should be a cooling air passage to become a blocked passage. This is the main problem with the very fine cooling passages such as those formed as the metering holes in the T/E region cooling circuit.

Applicant has discovered that the temperature profile for the T/E cooling circuit varies from the root to the blade tip. FIG. 7 shows a blade relative gas temperature profile for the blade of FIG. 1 where FIG. 6 shows the T/E region cooling circuit and FIG. 7 shows a graph of the temperature versus the blade span height with the blade tip on the top and the blade root on the bottom. What is important in the FIG. 7 graph is that the peak temperature occurs around the middle portion of the blade span height. Thus, additional cooling is required for the airfoil mean section to achieve a proper sectional or local metal temperature.

BRIEF SUMMARY OF THE INVENTION

An air cooled turbine rotor blade with a trailing edge region cooling circuit that includes rows of metering and impingement cooling holes followed by a row of exit slots or holes to discharge the spent cooling air. The rows of metering holes in the trailing edge region are supported by an upper and a lower continuous cooling air channel, and the rows of metering holes includes larger flow metering holes in the mid-span height holes than in the lower span or upper span metering holes in order to provide more cooling to the airfoil mid-span height section.

The upper and lower continuous cooling channels are formed by a ceramic core with the continuous cooling passages being of larger size such that the rows of metering holes are better supported in the mold during the casting process such that improved casting yields occur.

DETAILED DESCRIPTION OF THE INVENTION

A turbine blade for a gas turbine engine, especially for an industrial gas turbine engine, includes a trailing edge region cooling circuit with multiple rows of metering and impingement cooling holes followed by a row of exit slots or holes to discharge cooling air from the airfoil. the main part of the present invention is that the row of metering holes that extends along a spanwise length of the T/E includes larger sized metering holes in the middle section of the spanwise height than in the lower or upper spanwise height section in order to provide more cooling for the hotter middle spanwise height section of the T/E region of the airfoil. The T/E region cooling circuit of the present invention can be incorporated into the prior art air cooled turbine blades that use forward or aft flowing serpentine cooling circuits for the mid-chord region.

Figure 1:
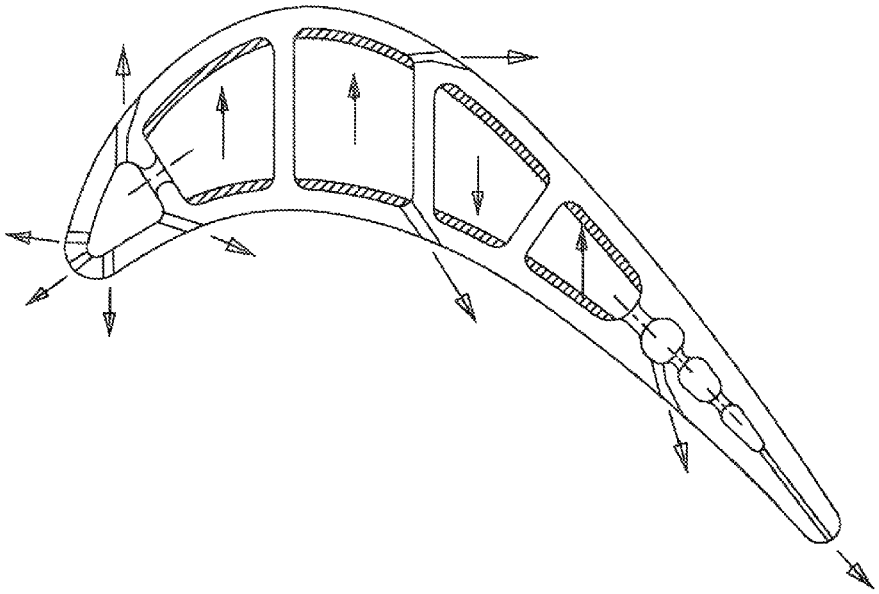
Fig 1 Prior Art
FIG. 1 shows a cross section top view of a cooling circuit for a prior art turbine blade.
Figure 2:
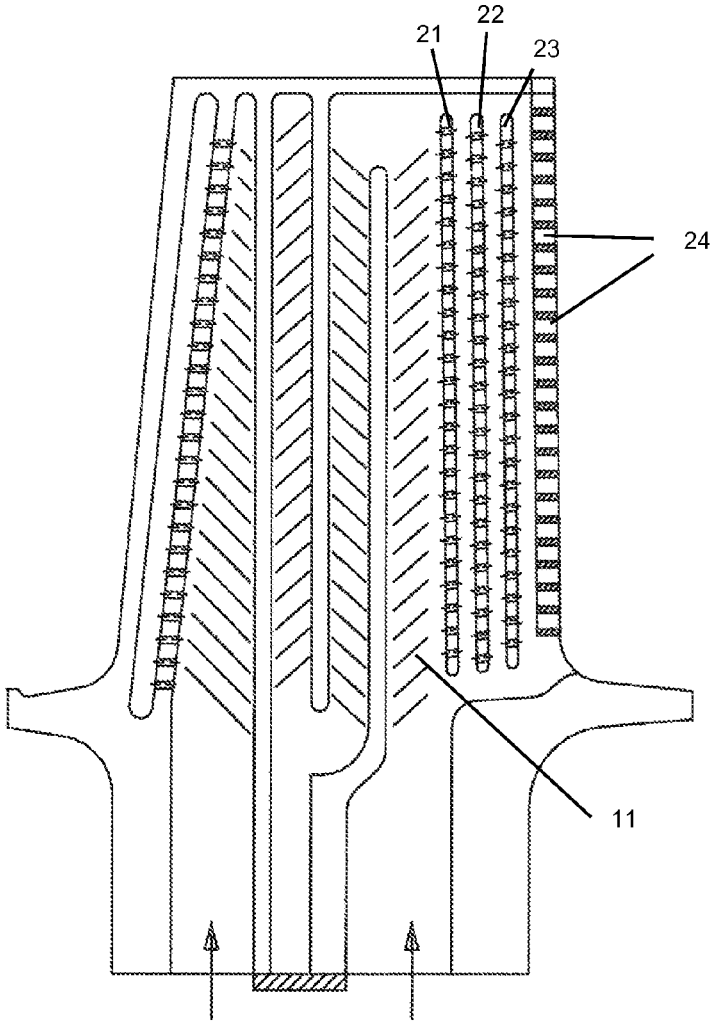
Fig 2 Prior Art
FIG. 2 shows a cross section side view for the prior art turbine blade of FIG. 1.
Figure 3:
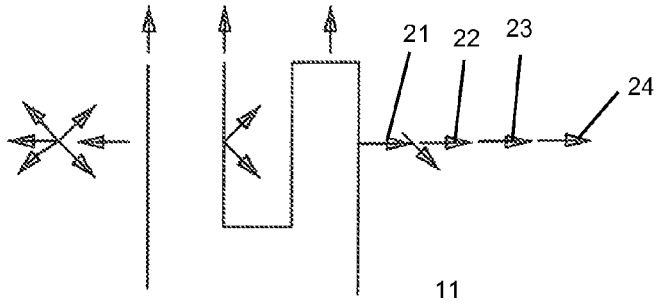
Fig 3 Prior Art
FIG. 3 shows a flow diagram for the prior art FIG. 1 turbine blade.
Figure 4:
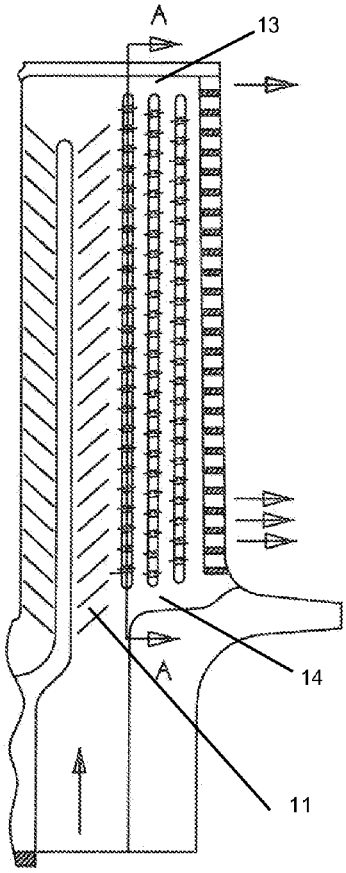
Fig 4 Prior Art
FIG. 4 shows a trailing edge region cooling circuit for the prior art FIG. 1 turbine blade.
Figure 5:
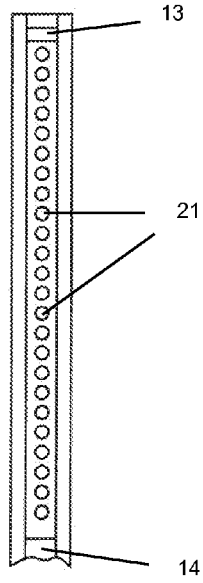
Fig 5 Prior Art
FIG. 5 shows a backside view of one row of metering holes of the prior art turbine blade of FIG. 4 through the line A-A.
Figure 6:
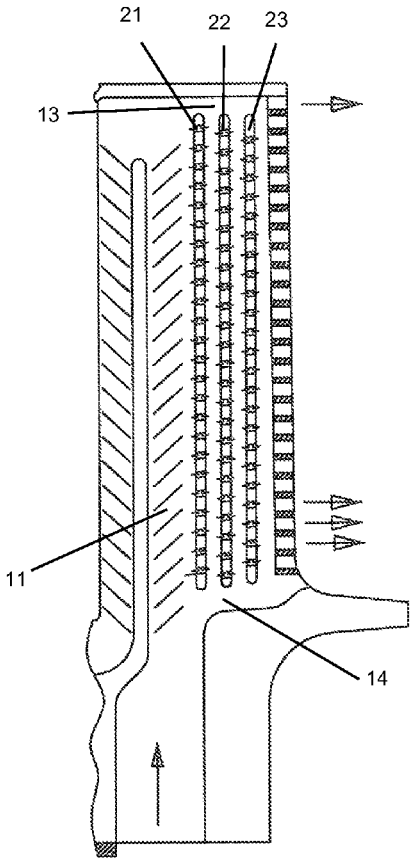
Fig 6 Prior Art
FIG. 6 shows a trailing edge region cooling circuit for the prior art FIG. 1 turbine blade.
Figure 7:
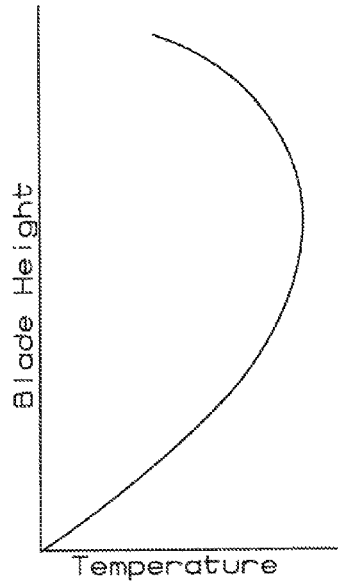
Fig 7 Prior Art
FIG. 7 shows a temperature profile curve for the prior art turbine blade in the trailing edge region corresponding to FIG. 6.
Figure 8:
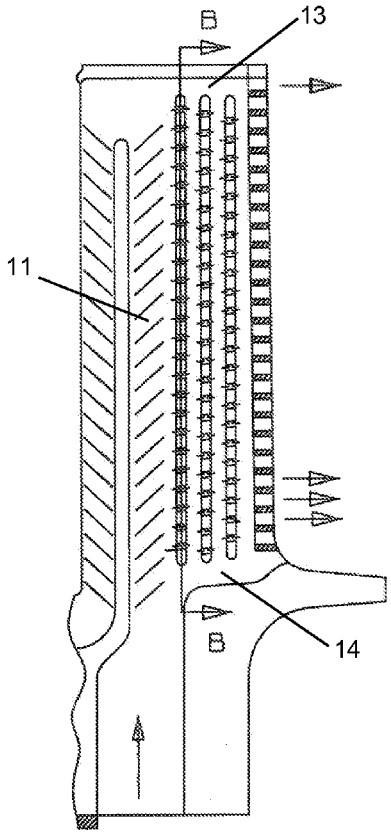
FIG. 8 shows a trailing edge cooling circuit for a turbine blade according to the present invention.
Figure 9:
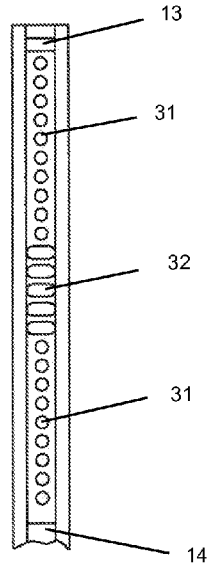
FIG. 9 shows a backside view of one row of metering holes of the turbine blade of FIG. 8 representing the present invention.

FIG. 8 shows a T/E region of an air cooled turbine blade that includes a three-pass forward flowing serpentine circuit with a first leg 11 located adjacent to the T/E region that supplies the cooling air for this T/E region. The blade includes three rows of metering holes that span the spanwise height of the airfoil between an upper continuous cooling channel 13 and a lower continuous cooling channel 14. The two continuous cooling channels 13 and 14 are formed by relatively large ceramic core pieces that add support for the ceramic core pieces that form the three rows of metering holes. As seen in FIG. 9, the first row of metering holes includes regular sized metering holes 31 in the upper spanwise height and in the lower spanwise height, while the middle spanwise height in-between these holes 31 includes larger flow area metering holes 32 that are elliptical in cross sectional shape in that the width is much more than the height. As per the discussion with respect to FIG. 7, the larger metering holes 32 provide for greater cooling air flow in this region of the T/E region of the airfoil that requires higher cooling amounts. As discussed with the larger continuous cooling channels 13 and 14, the larger metering holes 32 will also add stronger support for the ceramic core that is used to form the T/E region cooling circuit. The larger metering holes 32 have a width equal to the flow channel in the trailing edge region, which is the width between the inner surface of the pressure side wall and the inner surface of the suction side wall. The three rows of metering and impingement holes are formed within the T/E region flow channel.

Figure 10:
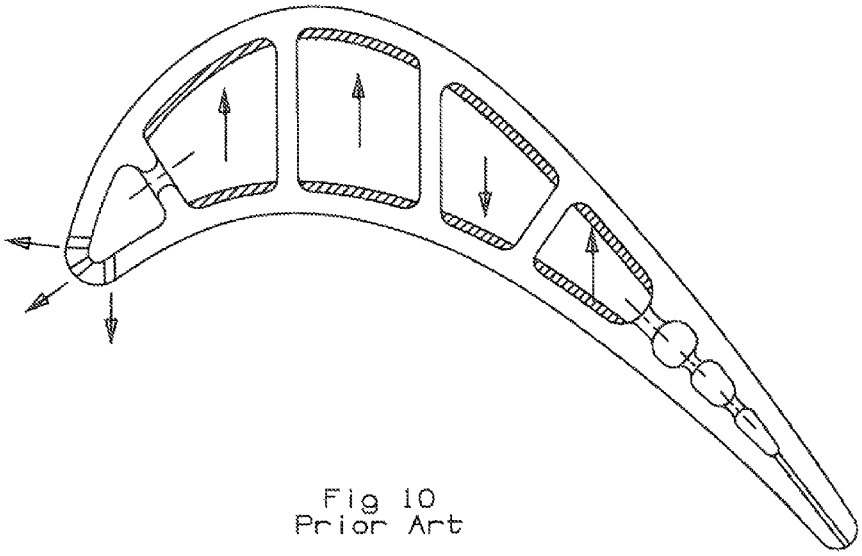
Fig 10 Prior Art
FIG. 10 shows a turbine blade of the prior art with an aft flowing serpentine circuit for the mid-chord region.
Figure 11:
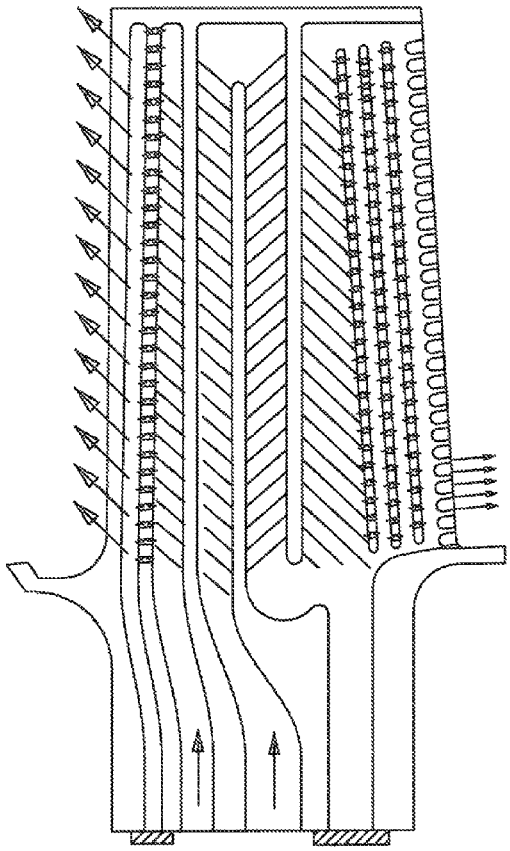
FIG. 11 shows a cross section side view of the blade of FIG. 10.
Figure 12:
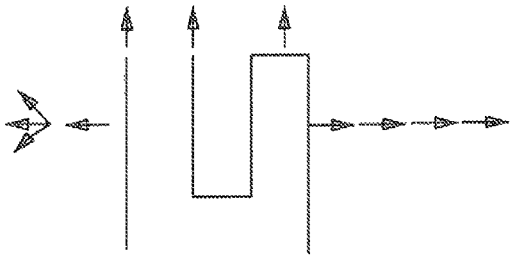
Fig 12 Prior Art
FIG. 12 shows a flow diagram for the turbine blade cooling circuit of FIGS. 10 and 11.

FIGS. 10 and 11 shows a turbine blade with an aft flowing three-pass serpentine flow circuit for the mid-chord region in which the last or third leg of the serpentine is located adjacent to the T/E region cooling circuit. The T/E region is cooled by three rows of metering holes in which the rows of metering holes can have the shape as that disclosed in FIG. 9 of the present invention. FIG. 11 shows a cross section side view of the blade cooling circuit and FIG. 12 shows a flow diagram for it. The different sized metering holes in the middle span of the airfoil can be included in the blade cooling circuit of FIGS. 10-12 to provide for higher levels of cooling in the hotter section of the T/E region.

The T/E cavities and their associated metering holes are designed considering both heat transfer effectiveness and castability, including leaching the ceramic core material after casting as well as formation requirement for the ceramic core stiffness in the manufacturing process. The mainstream gas temperature profile peaks out in the blade middle spanwise section than in the tip and root sections. Additional cooling is required for the blade mean section to achieve the proper sectional or local metal temperature. The T/E cooling air ceramic core stiffness can be improved with the T/E cooling circuit of the present invention.

Major design features and advantages over the prior art impingement holes design is described below. At the blade mid-span location where the mainstream gas temperature peaks, the impingement holes are at a larger flow with an elliptical cross section shape. The mid-section wider impingement holes increase cooling flow rate at this particular blade span location to provide more cooling to the hottest section of the blade T/E region. The impingement rib with this cooling design without a change to the cooling holes configuration at the blade lower and upper span height retains the original blade trailing edge design requirements. The T/E impingement hole design of the present invention will enhance the airfoil T/E ceramic core stiffness and thus minimize the ceramic core breakage to improve the manufacturing casting yields. For the T/E impingement rib design with wall to wall impingement holes, the ceramic core for the cooling supply channel and multiple impingement cavities are tied together by a series of wall-to-wall cross-over holes at a staggered array relative the each impingement row. This particular arrangement transforms the T/E triple impingement core into a rectangular grid structure as the blade mid-span height and thus increases the ceramic core stiffness. At the wall-to-wall impingement hole location, an increase of ceramic core cross sectional area is obtained, and this reduces the core breakage due to shear that is caused by a differential shrink rate of the ceramic core, the external shell and the molten metal. Since a moment of inertia is proportional exponentially to the ceramic core thickness, additional local wall-to-wall cross-over holes provide by the present invention design increases the moment of inertia for the ceramic core which improves the resistance to T/E local edge ending. At the wall-to-wall impingement hole location, an increase of the total moment of inertia for the ceramic core is achieved and thus a reduction in the bending stress that improves the resistance due to overall T/E bending.

I claim the following:

1. An air cooled turbine rotor blade comprising:

an airfoil with a leading edge region and a mid-chord region and a trailing edge region;

a multiple pass serpentine flow cooling circuit within the mid-chord region;

a plurality of rows of metering and impingement holes within the trailing edge region;

one leg of the serpentine flow cooling circuit having an aft wall formed by the first row of the metering and impingement holes; and, each row of metering and impingement holes includes smaller diameter metering holes in an upper span and a lower span of the row and larger flow area holes in a middle span.

2. The air cooled turbine rotor blade of claim 1, and further comprising:

the larger flow area holes in the middle span of the rows have a greater width than height.

3. The air cooled turbine rotor blade of claim 2, and further comprising:

the larger flow area holes in the middle span of the rows are elliptical in cross sectional shape.

4. The air cooled turbine rotor blade of claim 1, and further comprising:

the multiple pass serpentine flow cooling circuit is a three-pass serpentine flow circuit.

5. The air cooled turbine rotor blade of claim 1, and further comprising:

the trailing edge region cooling circuit includes three rows of metering and impingement holes each separated by a lower continuous cooling channel and an upper continuous cooling channel.

6. The air cooled turbine rotor blade of claim 4, and further comprising:

the three-pass serpentine flow cooling circuit is a forward flowing serpentine circuit with a first leg located alongside a first row of the metering and impingement cooling holes.

7. The air cooled turbine rotor blade of claim 4, and further comprising:

the three-pass serpentine flow cooling circuit is an aft flowing serpentine circuit with a third leg located alongside a first row of the metering and impingement cooling holes.

8. The air cooled turbine rotor blade of claim 1, and further comprising:

the air cooled turbine rotor blade is a first or second stage turbine blade for an industrial gas turbine engine.

9. The air cooled turbine rotor blade of claim 1, and further comprising:

the middle span metering holes with the larger flow area form around one third of the number of metering holes in the row.

10. The air cooled turbine rotor blade of claim 1, and further comprising:

the larger flow area holes in the middle span of the rows have a width equal to a width of the flow channel in the trailing edge region.

11. The air cooled turbine rotor blade of claim 1, and further comprising:

the larger flow area holes in the middle span of the rows have a width that is wall-to-wall in the trailing edge flow channel.

* * * * *